United States Patent [19]

Winter et al.

[11] Patent Number: 4,858,774

[45] Date of Patent: Aug. 22, 1989

[54] SHELVING SYSTEM

[75] Inventors: Russell K. Winter, Crownsville; Thomas D. Harvey, Rockville; Richard S. Kain, Woodbine; Nedin Savas, Bethesda, all of Md.

[73] Assignee: Russel William Ltd., Odenton, Md.

[21] Appl. No.: 174,853

[22] Filed: Mar. 29, 1988

[51] Int. Cl.[4] ..... A47F 5/00

[52] U.S. Cl. ..... 211/184; 29/464; 108/61; 403/353

[58] Field of Search ..... 211/184, 187; 108/110, 108/60, 61; 220/22.1, 22.3, 22.6; 403/353; 29/464, 452, 453

[56] References Cited

U.S. PATENT DOCUMENTS

| | | | |
|---|---|---|---|
| 2,596,332 | 5/1952 | Flora et al. | 403/353 X |
| 2,845,188 | 7/1958 | Rosenquist et al. | 211/184 |
| 2,905,336 | 9/1959 | Highberg | 211/184 |
| 3,160,282 | 12/1964 | Gunn | 211/184 |
| 3,269,558 | 8/1966 | Hess | 211/184 |
| 4,023,682 | 5/1977 | Niece | 108/61 X |
| 4,625,471 | 12/1986 | Cheng | 108/60 X |

*Primary Examiner*—Alvin C. Chin-Shue

*Assistant Examiner*—David L. Talbott

*Attorney, Agent, or Firm*—Morton J. Rosenberg

[57] ABSTRACT

A shelving system (10) is provided for displaying articles within partitioned areas defined by a partition (30). Partition (30) is engaged to both the shelf bottom wall (24) and rear wall (25) in a reversibly locking manner. Partition (30) comprises a plate (32) having a tab member (60) which engages the rear wall (24) of shelf (20) through a slotted opening (23). Plate (32) further comprises an angularly directed tab member (70) which engages the bottom wall (24) of shelf (20) through slotted opening (27). Angularly directed tab member (70) includes a camming surface (76) which acts to translate vertical forces to rear wall (24) for displacement thereof relative to bottom wall (24). The elastic displacement of rear wall (22) permits angularly directed tab (70) to pass through slotted opening (27) such that the front edge of slotted opening (27) engages detent (74) of the angularly directed tab member (70). Plate (32) further includes an arcuate alignment member (34), at least partially insertable into slotted through opening (25) for aligning plate (32) during engagement and disengagement from shelf (20), as well as adding to the stability of the partition when engaged to shelf (20).

12 Claims, 2 Drawing Sheets

SHELVING SYSTEM

BACKGROUND OF THE INVENTION

1. FIELD OF THE INVENTION

This invention directs itself to displays systems having at least one relocatable member for separating articles located thereon. In particular, this invention directs itself to modular and pre-fabricated type display systems which include the advantage of simiplicity of construction while maintaining an aesthetically pleasing display system. Still further, this invention directs itself to shelving systems having relocatable partitions which are reversibly lockingly engaged with the shelves. More in particular, this invention pertains to a partition which is lockingly engaged with both a rear wall and a bottom wall of the shelf. Further, this invention directs itself to a partition having a camming surface for directing forces to cause the rear wall to be elastically displaced relative to the bottom wall to permit engagement therewith, and a reversible locking engagement subsequent to the return of the rear wall to its original position.

2. PRIOR ART

Display type shelving systems are well-known in the art. Shelving systems with relocatable partitions are also well-known in the art. However, such prior art systems require special brackets to support the relocatable partitions, thus detracting from the aesthetic appearance of the shelving system.

In other prior art systems, relocatable partitions are slidingly engaged to the shelving members and not locked in position. In commercial applications, such partitions become a nuisance, as they are easily dislodged, permitting the display items to become intermixed and disarrayed. Further, the partitions of prior art shelving systems do not provide a means of alignment for guiding the partition during both the engagement and disengagement processes, making them far more difficult to use than the invention herein described.

SUMMARY OF THE INVENTION

A shelving system for displaying articles within partitioned areas is provided. The shelving system includes at least one shelf having a vertical wall flexibly mounted to a horizontal bottom wall. The shelving system also includes a divider for defining the partitioned areas after being inserted at least partially into an opening in the vertical wall, displacing the vertical wall relative to the bottom wall, and then lockingly engaging the bottom wall subsequent to the return of the vertical wall to its original position.

DESCRIPTION OF THE PREFERRED EMBODIMENTS

Referring now to FIGS. 1–6, there is shown shelving system 10 for displaying articles within partitioned areas located thereon. As will be seen in following paragraphs, shelving system 10 is specifically directed to the concept of providing relocatable partitions 30 which engage shelf 20 in a reversibly locking manner. The novel method of providing for the reversible locking engagement of partition 30 to shelf 20 is a simple mechanism promoting ease of utilization, while maintaining an aesthetically pleasing shelving system 10. Although not restricted to commercial utilization, shelving system 10 is particularly adapted for use as a display type system in commercial establishments where it is desired to constantly vary the display to the buying public, maintain a visually attractive display, and simultaneously maintain a low display cost.

Figure 1:
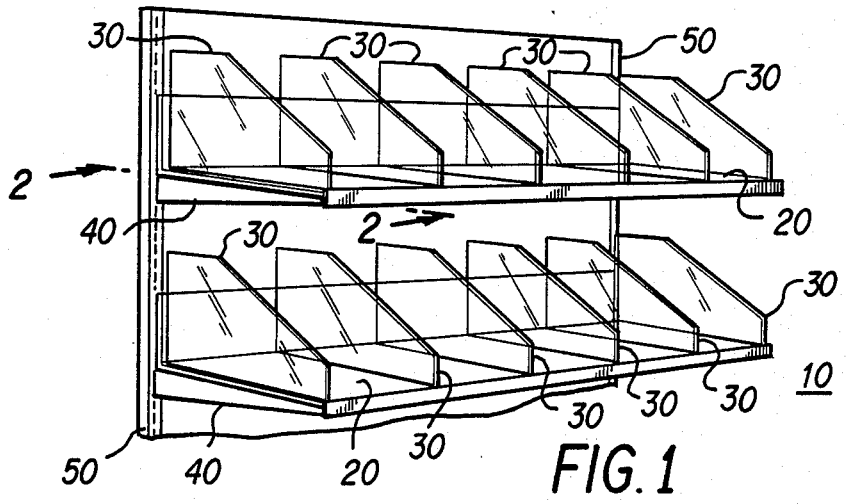
FIG. 1 is a perspective view of the shelving system.

As shown in FIG. 1, shelving system 10 may include one or more shelves 20 which are supported by shelf supports 40. Shelf supports 40 are coupled to posts or stanchions 50, by methods well known in the art. Shelf 20 may include one or more partitions 30 mounted thereon.

Figure 2:
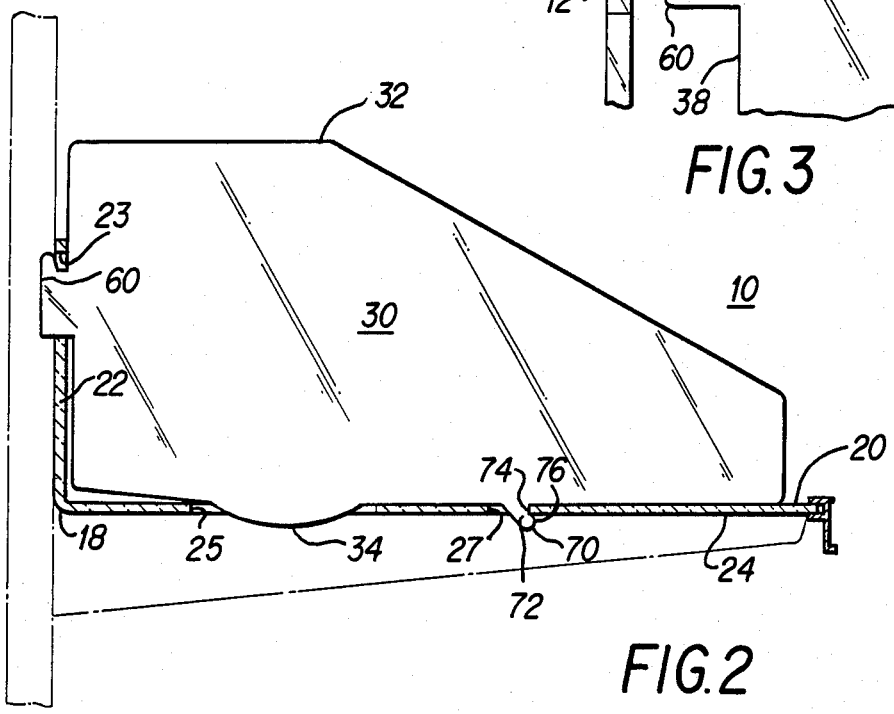
FIG. 2 is a sectional view of the shelving system taken along Section Line 2—2 of FIG. 1.

Referring now to FIG. 2, there is shown a sectional view of shelving system 10 showing partition 30 lockingly engaged to shelf 20. Shelf 20 includes at least one substantially vertical wall 22 flexibly mounted to a substantially horizontal bottom wall 24. Vertical wall 22 and bottom wall 24 are shown as being formed in a one-piece formation with a bend indicated at 18. However, walls 22 and 24 may be formed as separate elements and flexibly mounted one to the other by any method which would allow elastic deformation of one wall relative to the other. Shelf walls 22 and 24 each include at least one slotted through opening for insert, at least partially, of at least a portion of partition 30. Rear wall 22 includes a slotted through opening 23 whose length dimension is substantially vertical. In the embodiment shown in FIG. 2, bottom wall 24 includes a pair of slotted openings 25 and 27, serially located with through opening 25 being located closer to rear wall 22 than through opening 27. Although two slotted openings 25 and 27 are shown in the embodiment of FIG. 2, it should be clear that a single large slotted opening could be use in place of slotted openings 25 and 27 without departing from the inventive concept, as herein described.

Partition 30 is formed from a plate 32 having at least two tab members 60 and 70 formed thereon. Tab member 60 is located on a rear edge of plate 32 so as to be insertable into slot 23 formed in rear shelf wall 22. Tab member 70 is located on a bottom edge of plate 32 and located so as to be insertable into slotted through opening 27 of bottom wall member 24, subsequent to shelf walls 22 and 24 being displaced one from the other, as will be described in following paragraphs.

Plate 32 of partition 30 further includes an arcuate alignment member 34 located on he bottom edge of plate 32 and to the rear of tab member 70, for insert into slotted through opening 25 formed in bottom shelf wall 24. Alignment member 34 aids in the alignment of partition 30 during the process of lockingly engaging partition 30 with shelf 20.

Tab member 70 is angularly directed from the bottom edge of plate member 32 having a detent portion 74 for engagement with an edge of slotted through opening 27 of bottom shelf wall 24. The distal end of tab member 70 includes a rounded cam portion 76 which terminates at detent 74 on one end and at the angular rear face 72 of tab member 70. The rounded camming portion 76 of tab member 70 provides for ease of insertion and removal of tab member 70 from slotted through opening 27, subsequent to relative displacement of rear shelf wall 22 with respect to bottom shelf wall 24.

Figure 3:
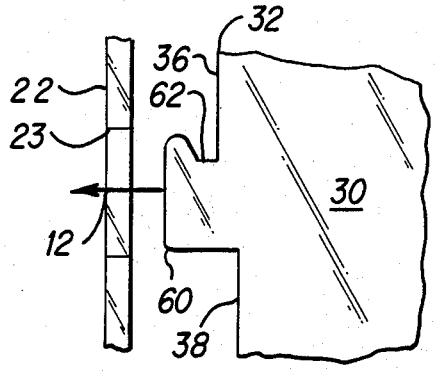
FIG. 3 is an expanded view of a portion of the partition of the shelving system.

Referring now to FIG. 3, there is shown a cut-away view of tab member 60 prior to insert into slotted through opening 23 of rear shelf wall 22. As is shown, tab member 60 includes a recessed portion 62 dimensioned to permit vertical displacement of tab member 60 within slotted through opening 23. The rear edge of plate member 32 comprises two sections, an upper section 36 located above tab member 60 and a lower section 38 located below tab member 60. Upper section 36 of the rear edge of plate 32 is dimensioned so as to be further from the front end of plate 32 than lower section 38. This arrangement permits the upper section 36 to contact rear shelf wall 22 and apply displacement forces thereto, without interference or contact from lower section 38. Thus, when tab member 60 is inserted axially along direction arrow 12 into slotted through opening 23, upper section 36 contacts that portion of rear shelf wall 22 which is above slotted through opening 23. This provides a force moment about the junction 18 of rear shelf wall 22 and bottom shelf wall 24, to cause relative displacement of the shelf walls 22 and 24, as shown in FIG. 2.

Figure 4:
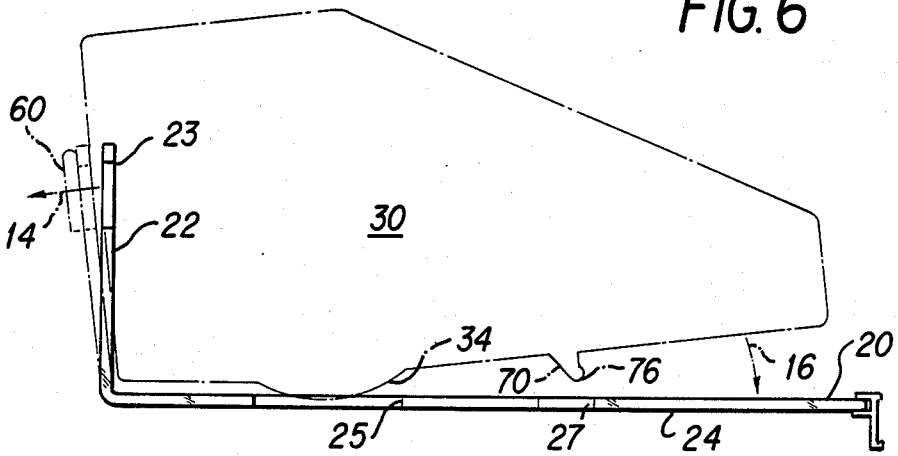
FIG. 4 is a plane view of the shelving system depicting the method by which the partition is reversibly lockingly engaged to the shelf.

Referring now to FIG. 4, there is illustrated the method by which partition 30 is reversibly lockingly engaged with shelf 20. The relative dimensions depicted in the Figure are exaggerated so as to aid in understanding the inventive concept as herein described.

Referring to FIGS. 2–4, partition 30 is lockingly engaged to shelf 20 by first inserting tab member 60 into slotted through opening 23 until the upper portion 36 of the rear edge of plate 32 comes in contact with the rear shelf wall 22. While simultaneously allowing alignment projection 34 to be inserted, at least partially, into slotted through opening 25. Alignment projection 34 providing a guide to properly align partition 30 during engagement and disengagement from shelf 20.

At this point in the process of engaging partition 30 with shelf 20, angularly directed tab member 70 will not be able to be inserted into slotted through opening 27 in bottom shelf wall 24. The location of angularly directed tab member 70 has been predetermined such that the camming surface 76 strikes a forward edge of slotted through opening 27 so as to interfere with the insertion thereof. By applying a force to partition 30, directed along direction arrow 14, causes rear shelf wall 22 to be radially displaced relative to bottom shelf wall 24 sufficiently to allow camming surface 76 to pass through opening 27 as partition 30 is rotated along direction arrow 16, until the bottom edge of partition 30 is in contact with the bottom shelf wall 24. Upon release of rear shelf wall 22 from its displaced position, such returns to its original state forcing the forward edge of slotted through opening 27 into detent 74 of angularly directed tab member 70. Similarly, disengagement of partition 30 requires radial deflection of rear wall 22 to permit removal of the interference between the front edge of slotted through opening 27 and detent 74 in angularly directed tab member 70.

The camming surface 76 provides the means to translate the forces applied to partition 30, along direction arrow 16 into the components necessary to cause the releasable locking engagement as previously described. As force is applied along direction arrow 16 to partition 30, the camming surface 76 strikes the forward edge of slotted through opening 27, causing partition 30 to rotate about that point. This action causes tab member 60 to move vertically causing the edge of slotted through opening 23 to enter the recessed area 62 of tab member 60. The contour of the camming surface 76 applies a force along direction arrow 14, causing rear shelf wall 22 to be displaced radially about bend 18, until camming surface 76 has sufficiently cleared the edge of through opening 27 so as to pass therethrough. Since the displacement of rear wall 22 relative to bottom wall 24 of shelf 20 is an elastic deformation, rear wall 22 returns to its original position subsequent to removal of the insertion forces applied to partition 30. Return of rear shelf wall 22 to its original position forces the front edge of slotted through opening 27 into detent 74 of tab member 70, creating a locking engagement thereof.

During the reverse process of removing partition 30, an oppositely directed force on partition 30 causes the camming surface 76 of tab member 70 to translate a portion of this force along direction line 14, and thus, cam the rear shelf wall 22 relative to bottom shelf wall 24, as has been previously described. Once camming surface 76 has cleared the edge of through opening 27, partition 30 need only be rotated slightly to allow tab member 60 to drop down such that the recess 62 is no longer engaged with the uppermost edge of slotted through opening 23, and thus, allowing tab member 60 to be withdrawn from through opening 23. This provides the means to reverse the locking engagement of partition 30 to shelf 20.

Therefore, as has been previously described, shelving system 10 is provided with at least one relocatable partition for separating articles displayed thereon. Display system 10 includes shelf 20 having a substantially vertical rear wall 22 with slotted through opening 23 formed therein, and a substantially horizontal bottom wall 24 with serially arranged slotted through openings 25 and 27 formed therein.

Partition 30 comprises a plate 32 having a pair of tab members 60 and 70 for providing a releasable locking engagement with both substantially vertical rear wall 22 and substantially horizontal bottom wall 24. Plate 32 further includes an arcuate alignment projection 34 for insert into through opening 25 of bottom shelf wall 24. In addition to providing alignment for the engagement and disengagement of partition 30 with shelf 20, arcuate alignment projection 34 adds to the stability of partition 30 when partition 30 is lockingly engaged with shelf 20, by adding an increased area of engagement therebetween. Alignment projection 34 is located and dimensioned so as to be insertable within slotted opening 25 subsequent to insertion of tab member 60 into slotted through opening 23, but prior to insertion of tab member 70 being inserted into slotted through opening 27.

Tab member 60 is located on a rear edge of plate 32 intermediate the upper section 36 of the rear edge of plate 32 and the lower section 38 of the rear edge of plate 32. Tab member 60 includes a recessed area 62 dimensioned to allow vertical displacement of tab member 60 within slotted through opening 23, by allowing sufficient clearance within recessed area 62 to allow the uppermost edge of slotted through opening 23 to freely pass into the recess 62. The upper section 36 of the rear edge of plate 32 is dimensioned so as to contact the rear shelf wall 22 prior to lower section 38 of the rear edge of plate 32 when tab member 60 is inserted into through opening 23. Therefore, the lateral force required to displace rear wall 22 relative to bottom wall 24 is applied by upper section 36 of the rear edge of plate 32. This creates a larger force moment about junction 18 for causing the radial displacement of rear wall 22 relative to bottom wall 24. Thus, less force is required for displacement of shelf wall 22 than if both upper and lower sections 36 and 38 of the rear edge of plate 32 contacted rear wall 22.

Angularly directed tab member 70 comprises an angular rear face 72 extending from the bottom edge of plate 32 to camming face 76. Camming face 76 is shaped and dimensioned to provide an interference with the forward edge of slotted through opening 27 and provide a translation of forces to cause the radial displacement of rear shelf wall 22 as a result of the camming action of camming face 76 against the forward edge of through opening 27. Camming face 76 terminates in a detent 74 which lockingly engages the forward edge of slotted through opening 27 subsequent to the elastic return of rear shelf wall 22 to its original position, after having been subjected to the radial displacement previously described.

Removal of tab member 70 from slotted through opening 27, during disengagement of partition 30 from shelf member 20, requires sufficient radial displacement of rear wall member 22 to release the forward edge of slotted through opening 27 from the detent area 74 onto camming surface 76. Once camming surface 76 is in contact with the forward edge of slotted through opening 27, all that is required is for an upwardly vertically directed force to be applied to partition 30, allowing the camming face 76 to cause the necessary displacement of rear shelf wall 22 to permit withdrawal of tab member 70 from the slotted through opening 27 formed in bottom shelf wall 24. Subsequent to disengagement of tab member 70 from slotted through opening 27 of bottom shelf wall 24, tab member 60 can be withdrawn from slotted through opening 23 in rear shelf wall 22, completing the disengagement of partition 30 from shelf 20.

Figure 5:
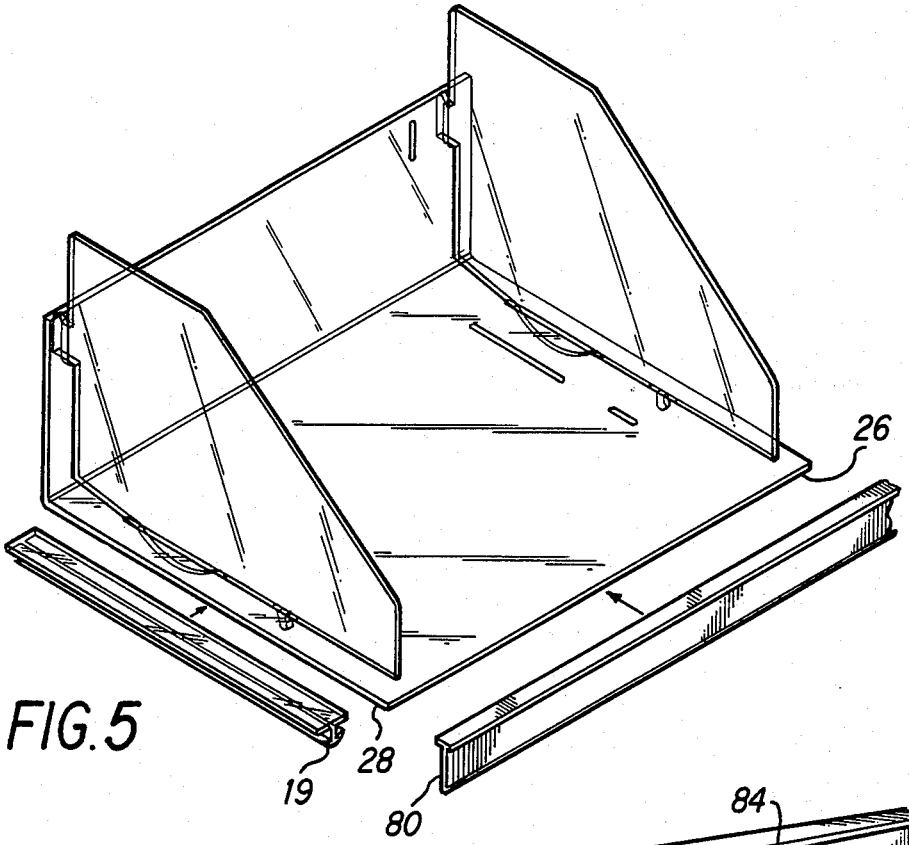
FIG. 5 is a perspective view of the shelving system and accessory items therefor; and, FIG. 6 is a perspective view of a front edge channel for use with the shelving system.
Figure 6:
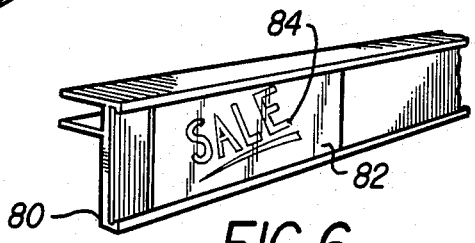

Referring now to FIGS. 5 and 6, there are shown accessory items for shelving system 10. While shelving system 10 is manufactured with predetermined length dimensions, units can be coupled one to the other to provide a system of shelving of a length to suit the particular application. This linear attachment of shelves 20 one to the other is accomplished by an "H" channel 19. The shelf edges 28 of a pair of shelves 20 are inserted on opposing sides of channel 19, thus joining two shelves 20. As is well-known to those skilled in the art, "H" channel 19 is secured to edge 28 of shelf 20 by means of a tight or interference fit, providing a structurally secure joining of shelves 20.

Secured in a similar manner, front edge channel 80 is mounted to front edge 26 of shelf 20. Front edge channel 80 may take various forms and configurations to add to the visual aesthetics of shelving system 10. Front edge channel 80 may be adapted to hold a sign 82 having indicia 84 located thereon, for drawing attention to the items contained in shelving system 10, indicating a price thereof, or the like. As an alternate construction, front edge channel 80 may be replaced by a front wall integrally formed on shelf 20.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. shelving system for displaying articles within partitioned areas; comprising:

a. shelf means for supporting said articles; said self means having at least one substantially vertical wall flexibly mounted to a substantially horizontal bottom wall; and, b. divider means for defining said partitioned areas, said divider means includes a plate member having (1) on a first end an integrally formed tab having an upwardly directed hook-shaped contour for pivotal insert into a slotted through opening formed in said substantially vertical wall, and (2) on a second end substantailly orthogonal said first end a second and third tab member integrally formed thereon for insert into a pair of corresponding through openings formed in said bottom wall; said second tab member being angularly directed in a direction extending away from both said first and second ends of said plate member for preventing insert or withdrawal of said plate member prior to said bottom and substantially vertical walls being flexibly displaced by a camming surface formed on said second tab member from a first position to a second position each from the other, and said plate member being subsequently lockingly engaged when said bottom and substantially vertical walls are releasably displaced to said first position.

2. The shelving system as recited in claim 1 where said pair of slotted through openings in said bottom wall are serially arranged with a first through opening located in front of a second through opening.

3. The shelving system as recited in claim 2 where said first tab member includes a recess for allowing vertical displacement within said slot formed in said substantailly vertical wall.

4. The shelving system as recited in claim 1 where said substantially vertical wall and said substantially horizontal bottom wall are formed in one piece formation.

5. A display system having shelves with at least one relocatable member for separating articles located thereon, comprising:

a. shelf means for supporting said articles and having at least two substantially orthogonal shelf members coupled elastically one to the other; and, b. at least one partition means releasably coupled to said shelf means for said separation of said articles; said partition means including said relocatable member having at least two tab members, each of said tab members being located for releasable engagement with one of said shelf members; said tab members being directed in opposing directions to form a reversible locking engagement requiring the radial displacement of one of said shelf members relative to the other; one of said tab members having a camming surface for transmitting a force to cause said radial displacement responsive to said engagement of said tab members.

6. The display system as recited in claim 5 where said two substantially orthogonal shelf members are formed in one piece formation.

7. The display system as recited in claim 5 where one of said two tab members is defined by a first tab member formed on a first end of said relocatable member for insert into a slotted through opening formed in one of said two shelf members.

8. The display system as recited in claim 7 where said first tab member includes a recessed portion defining an upward hook-shaped contour allowing lateral displacement of said first tab member within said slotted through opening formed in said one of said two shelf members.

9. The display system as recited in claim 7 where an other of said two tab members is defined by a second tab member formed on a second end of said relocatable member for insert into a slotted through opening formed in the other of said two shelf members, said second end of said relocatable member being substantially orthogonal to said first end of said relocatable member.

10. The display system as recited in claim 9 wherein said second tab member is angularly directed in a direction extending away from both said first and second end of said relocatable member; said angularity for (1) preventing insert of said second tab member into said slotted through opening formed in said other of said two shelf members prior to said radial displacement of one of said shelf members relative to said other, and (2) providing in combination with said first tab member said reversible locking engagement of said relocatable member to both said shelf members subsequent to return of said shelf members from said radial displacement.

11. The display system as recited in claim 9 where said partition means includes an arcuate alignment member formed on said second end of said relocatable member for insert into said slotted through opening formed in said other of said two shelf members.

12. The display system as recited in claim 11 where said alignment member is located intermediate said first and second tab members.

* * * * *